US006481506B2

(12) United States Patent
Okada et al.

(10) Patent No.: US 6,481,506 B2
(45) Date of Patent: Nov. 19, 2002

(54) DUAL TILT CONTROL SYSTEM FOR WORK VEHICLE

(75) Inventors: Toshikazu Okada, Osaka (JP); Ikuo Kita, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/821,793

(22) Filed: Mar. 30, 2001

(65) Prior Publication Data

US 2002/0134560 A1 Sep. 26, 2002

(30) Foreign Application Priority Data

Mar. 22, 2001 (JP) ..... 2001-082141

(51) Int. Cl.[7] ..... E02F 3/85
(52) U.S. Cl. ..... 172/812; 91/448; 91/531
(58) Field of Search ..... 172/811, 812, 172/813, 818, 821, 822, 823, 826, 831; 60/468; 91/531, 448, 519, 521, 525, 527, 530, 532, 461

(56) References Cited

U.S. PATENT DOCUMENTS 4,086,843 A * 5/1978 Lorimor
4,523,430 A * 6/1985 Masuda
4,802,537 A 2/1989 Ryerson ..... 172/812
5,426,874 A * 6/1995 Nakata et al.
5,620,053 A * 4/1997 Kamikawa et al.
5,682,955 A 11/1997 Groth et al. ..... 172/811
5,799,737 A * 9/1998 Kamikawa et al.
5,862,868 A * 1/1999 Yamamoto et al.
5,983,151 A * 11/1999 Okada et al.
5,996,703 A * 12/1999 Yamamoto et al.
6,035,241 A 3/2000 Yamamoto ..... 700/40
6,129,158 A * 10/2000 Yamamoto et al.
6,378,303 B1 * 4/2002 Higuchi et al.

FOREIGN PATENT DOCUMENTS

JP 63-501228 5/1988
JP 8-260506 10/1996
JP 10-110447 4/1998

* cited by examiner

*Primary Examiner*—Victor Batson
(74) *Attorney, Agent, or Firm*—Armstrong, Westerman & Hattori, LLP.

(57) ABSTRACT

To provide a dual tilt control system for a work vehicle, the system being capable of using a switching valve adapted to low pressure and low flow rates and left and right tilt cylinders of the same diameter and yielding large force during pitch and dual tilt operations and requiring no piston valve. A left tilt cylinder driving hydraulic circuit and a right tilt cylinder driving hydraulic circuit for respectively supplying pressure oil from a hydraulic pump to the left and right cylinders are arranged in parallel and comprise a left tilt cylinder actuation switching valve and a right tilt cylinder actuation switching valve, respectively. In a pilot pressure signal circuit for controlling the tilt cylinder actuation switching valves, a pilot switching valve for switching a blade between the pitch operation, a single tilt operation and the dual tilt operation by means of the left and right cylinders is provided.

4 Claims, 5 Drawing Sheets

DUAL TILT CONTROL SYSTEM FOR WORK VEHICLE

FIELD OF THE INVENTION

The present invention relates to a dual tilt control system for a work vehicle, the system controlling a blade pivotably connected to a vehicle body by means of a pair of left and right tilt cylinders for pitch and tilt operations.

BACKGROUND OF THE INVENTION

Conventionally, a work vehicle such as a bulldozer excavates, carries soil and levels the ground after excavation by means of a blade coupled to the front of a vehicle body through a pair of straight frames. One known technique of controlling the blade is as follows. A pair of left and right tilt cylinders (pitch cylinders), that is, double-acting hydraulic cylinders are provided between the blade and the vehicle body. When these tilt cylinders are driven simultaneously so as to extend or retract, the blade assumes a pitch dump posture (forward-tilting posture) or a pitch back posture (backward-tilting posture). When one of the tilt cylinders is driven so as to extend or retract with the other tilt cylinder remaining at rest, the blade assumes such a posture (right-tilting posture or left-tilting posture) that its right edge or its left edge tilts downward.

There is also disclosed what is called a dual tilt control system (e.g., in Japanese Patent Publication No. 63-501228 (1988)) which drives one of the tilt cylinders for extension while driving the other tilt cylinder for retraction, thereby obtaining an increased velocity at which the blade is actuated to tilt.

The conventional dual tilt control system is explained further with reference to a hydraulic circuit diagram shown in FIG. 5. A dual tilt control system 100 controls a right tilt cylinder 101 and a left tilt cylinder 102, which connect the blade (not shown) and the vehicle body (not shown), for pitch and tilt operations.

In the dual tilt control system 100, a directional control valve 105 is connected to a hydraulic pump 103 and to a tank 104 and has control ports 106, 107 connected to respective valve ports 110, 111 of a two-position switching type pitch control valve 108 and a two-position switching type tilt control valve 109, respectively. The pitch control valve 108 also has a cylinder port 112 connected to a bottom oil chamber 102*a* of the left tilt cylinder 102 and cylinder ports 113, 114 connected to a bottom oil chamber 101*a* and a head oil chamber 101*b* of the right tilt cylinder 101, respectively. The tilt control valve 109 also has a cylinder port 115 connected to a head oil chamber 102*b* of the left tilt cylinder 102 and cylinder ports 116, 117 connected to the bottom oil chamber 101*a* and the head oil chamber 101*b* of the right tilt cylinder 101, respectively. The right tilt cylinder 101 is of larger diameter than the left tilt cylinder 102 so that the head oil chamber 101*b* of the right tilt cylinder 101 and the bottom oil chamber 102*a* of the left tilt cylinder 102 can be of equal cross-sectional area. When an operating lever (not shown) is manipulated, the directional control valve 105, the pitch control valve 108 and the tilt control valve 109 are actuated upon receipt of electric signals or pilot pressure signals.

In the case of pitch dump, the directional control valve 105 and the tilt control valve 109 are switched to their respective positions A, while the pitch control valve 108 is switched to position B. Pressure oil discharged from the hydraulic pump 103 is thus supplied through the control port 106 of the directional control valve 105, the valve port 110 and the cylinder port 113 of the pitch control valve 108 to the bottom oil chamber 101*a* of the right tilt cylinder 101, thereby actuating the right tilt cylinder 101 in an extending direction. The pressure oil from the head oil chamber 101*b* of the right tilt cylinder 101 is supplied through the cylinder ports 114, 112 of the pitch control valve 108 to the bottom oil chamber 102*a* of the left tilt cylinder 102, thereby also actuating the left tilt cylinder 102 in the extending direction. The pressure oil within the head oil chamber 102*b* of the left tilt cylinder 102 is exhausted through the cylinder port 115, the valve port 111 of the tilt control valve 109 and the control port 107 of the directional control valve 105 to the tank 104. The right and left tilt cylinders 101, 102 are thus extended simultaneously at an equal velocity, and consequently, the blade performs pitch dump (tilts forward). In the case of pitch back, the directional control valve 105 is switched to position B with the pitch control valve 108 and the tilt control valve 109 remaining in position B and position A, respectively. The pressure oil thus flows reversely to the direction described above, so that the right and left tilt cylinders 101, 102 are retracted simultaneously at an equal velocity. Consequently, the blade performs pitch back (tilts backward).

In the case of dual tilting to the right, the directional control valve 105 and the pitch control valve 108 are switched to their respective positions A, while the tilt control valve 109 is switched to position B. The pressure oil discharged from the hydraulic pump 103 is thus supplied through the control port 106 of the directional control valve 105, the valve port 110 and the cylinder port 112 of the pitch control valve 108 to the bottom oil chamber 102*a* of the left tilt cylinder 102, thereby actuating the left tilt cylinder 102 in the extending direction. The pressure oil from the head oil chamber 102*b* of the left tilt cylinder 102 is supplied through the cylinder ports 115, 117 of the tilt control valve 109 to the head oil chamber 101*b* of the right tilt cylinder 101, thereby actuating the right tilt cylinder 101 in a retracting direction. The pressure oil within the bottom oil chamber 101*a* of the right tilt cylinder 101 is exhausted through the cylinder port 116, the valve port 111 of the tilt control valve 109 and the control port 107 of the directional control valve 105 to the tank 104. The extension of the left tilt cylinder 102 and the retraction of the right tilt cylinder 101 are thus carried out simultaneously, and consequently, the blade tilts to the right at a high velocity (substantially double the normal velocity). In the case of dual tilting to the left, the directional control valve 105 is switched to position B with the pitch control valve 108 and the tilt control valve 109 remaining in position A and position B, respectively. The pressure oil thus flows reversely to the direction described above, so that the extension of the right tilt cylinder 101 and the retraction of the left tilt cylinder 102 are carried out simultaneously. Consequently, the blade tilts to the left at a high velocity (substantially double the normal velocity).

In the case of single tilting to the right, the directional control valve 105, the pitch control valve 108 and the tilt control valve 109 are switched to their respective positions A. The pressure oil discharged from the hydraulic pump 103 is thus supplied through the control port 106 of the directional control valve 105, the valve port 110, the cylinder port 112 of the pitch control valve 108 to the bottom oil chamber 102*a* of the left tilt cylinder 102, thereby actuating the left tilt cylinder 102 in the extending direction. The pressure oil from the head oil chamber 102*b* of the left tilt cylinder 102 is exhausted through the cylinder port 115, the valve port 111 of the tilt control valve 109 and the control port 107 of the directional control valve 105 to the tank 104. Only the extension of the left tilt cylinder 102 is thus carried out with the right tilt cylinder 101 remaining at rest, and consequently, the blade tilts to the right at a normal velocity (low velocity). In the case of single tilting to the left, the directional control valve 105 is switched to position B with the pitch control valve 108 and the tilt control valve 109 remaining in their respective positions A. The pressure oil thus flows reversely to the direction described above, so that only the retraction of the left tilt cylinder 102 is carried out with the right tilt cylinder 101 remaining at rest. Consequently, the blade tilts to the left at a normal velocity (low velocity).

The foregoing conventional dual tilt control system, however, has an inevitable problem of increased cost because of the following reason. The switching valves such as the pitch control valve 108 and the tilt control valve 109 are provided in a main hydraulic circuit intended for the tilt operation. This requires that the pitch control valve 108 and tilt control valve 109 be adapted to high pressure and high flow rates for use.

The foregoing conventional system also requires that the head oil chamber 101*b* of the right tilt cylinder 101 and the bottom oil chamber 102*a* of the left tilt cylinder 102 be of equal cross-sectional area for the pitch operation. Consequently, two types of cylinders that have bores of different diameters must be prepared, thus causing the cost to increase further.

Moreover, the foregoing hydraulic circuit has the right tilt cylinder 101 and the left tilt cylinder 102 that are arranged in series, so that a piston valve needs to be annexed to each of the cylinders 101, 102 to relieve the pressure oil when one of the cylinders reaches a stroke end first. This series arrangement also presents a problem that it cannot yield large force during the pitch and dual tilt operations.

The present invention addresses the problems discussed above and aims to provide a dual tilt control system for a work vehicle, the system being capable of using a switching valve adapted to low pressure and low flow rates and right and left cylinders of the same diameter and yielding large force during the pitch and dual tilt operations, and requiring no piston valve.

SUMMARY OF THE INVENTION

The above object can be accomplished by a dual tilt control system for a work vehicle according to a first aspect of the present invention, the dual tilt control system comprising: a blade pivotably connected to a vehicle body; a pair of left and right tilt cylinders disposed between the blade and the vehicle body; and tilt cylinder controlling means for controlling actuation of the tilt cylinders, the tilt cylinder controlling means comprising a hydraulic circuit comprising:

a left tilt cylinder driving hydraulic circuit for supplying pressure oil from a hydraulic pump to the left tilt cylinder, the left tilt cylinder driving hydraulic circuit comprising a left tilt cylinder actuation switching valve;

a right tilt cylinder driving hydraulic circuit for supplying the pressure oil from the hydraulic pump to the right tilt cylinder, the right tilt cylinder driving hydraulic circuit comprising a right tilt cylinder actuation switching valve; and a pilot pressure signal circuit for controlling the left tilt cylinder actuation switching valve and the right tilt cylinder actuation switching valve, the pilot pressure signal circuit comprising a pilot switching valve for switching the blade between a pitch operation, a single tilt operation and a dual tilt operation by means of the left and right tilt cylinders, wherein the left tilt cylinder driving hydraulic circuit and the right tilt cylinder driving hydraulic circuit are arranged in parallel.

According to the present invention, the pilot switching valve is provided in the pilot pressure signal circuit that controls the left tilt cylinder actuation switching valve and the right tilt cylinder actuation switching valve, and through actuation of the pilot switching valve, the blade is switched between the pitch operation, single tilt operation and dual tilt operation by means of the left and right tilt cylinders, so that the pilot switching valve can simply be adapted to low pressure and low flow rates, thus becoming low-cost. Moreover, the left tilt cylinder driving hydraulic circuit and the right tilt cylinder driving hydraulic circuit are arranged in parallel, so that the left and right tilt cylinders of the same diameter can find use, and large hydraulic force can be applied during the pitch operation and the dual tilt operation to yield large force. Furthermore, there is no need to annex a piston valve for relieving the pressure oil at a stroke end.

According to a second aspect of the present invention, it is preferable that a pressure compensating valve is provided on either an upstream side or a downstream side of each of the left and right tilt cylinder actuation switching valves so that differential pressure between the upstream and downstream sides of each of the left and right tilt cylinder actuation switching valves can stabilize. Even in cases where there is a difference in load pressure between the left and right tilt cylinders, the pressure compensating valves automatically adjust respective spool opening areas of the actuation switching valves, respectively so that a velocity at which the left tilt cylinder is actuated can always be equal to a velocity at which the right tilt cylinder is actuated. A displacement time of the left part of the blade can thus be equal to a displacement time of the right part of the blade during the pitch operation or the dual tilt operation, and these displacement times can be short, thus advantageously facilitating efficient operation.

According to a third aspect of the present invention that is based on the first aspect or the second aspect, it is preferable that each of the left and right tilt cylinder actuation switching valves has a ratio of a main spool opening area, which is used for supplying a head oil chamber of each of the left and right tilt cylinders with the pressure oil, to a main spool opening area, which is used for supplying a bottom oil chamber of each of the left and right tilt cylinders with the pressure oil, that is set equal to a ratio between respective cross-sectional areas of a head oil chamber and a bottom oil chamber of each of the tilt cylinders. Thus, a velocity at which pitch damp caused by the operation of each of the tilt cylinders is carried out can be equal to a velocity at which pitch back caused by the operation of each of the tilt cylinders is carried out, thus allowing more efficient operation.

DESCRIPTION OF THE PREFERRED EMBODIMENT

An embodiment of the present invention is concretely demonstrated hereinafter with reference to the accompanying drawings.

Figure 1:
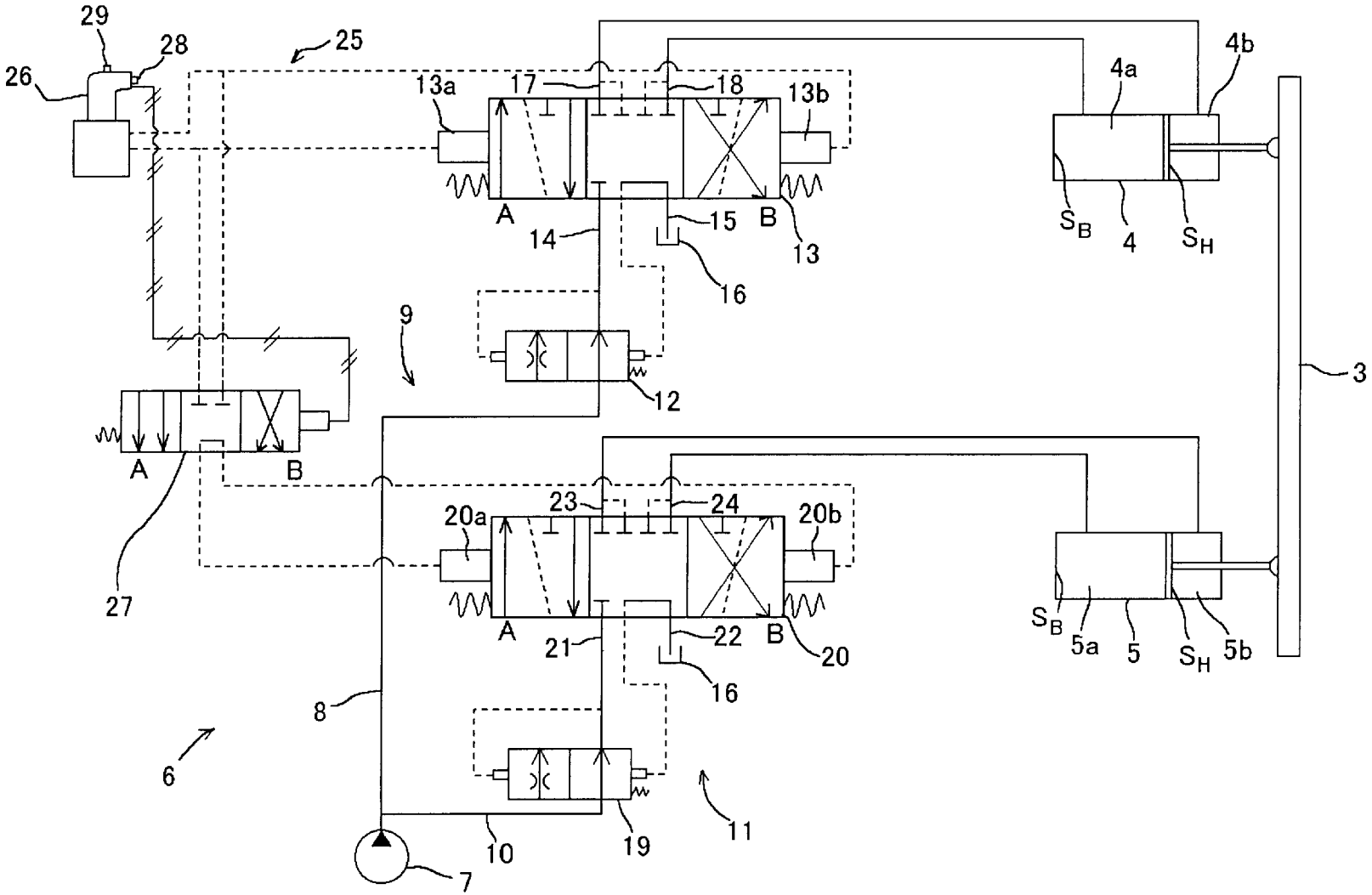
FIG. 1 is a hydraulic circuit diagram of a dual tilt control system in accordance with one embodiment of the present invention.
Figure 2:
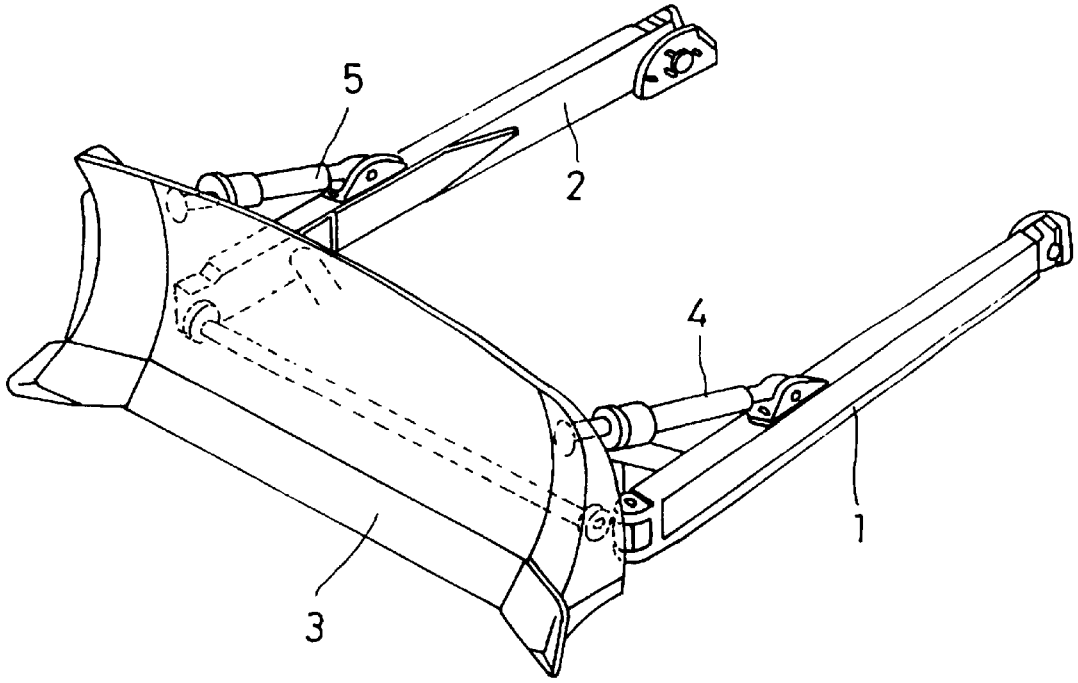
FIG. 2 is a perspective view illustrating the periphery of a blade to which the dual tilt control system in accordance with the embodiment is applied.

FIG. 1 is a hydraulic circuit diagram of a dual tilt control system in accordance with the embodiment of the present invention, and FIG. 2 is a perspective view illustrating the periphery of a blade to which the dual tilt control system in accordance with the embodiment is applied.

Described below is the embodiment applied to a bulldozer. As shown in FIG. 2, the bulldozer is provided with a pair of side-by-side straight frames 1, 2, the respective rear ends of which are supported at the outside of a truck frame of a vehicle body (not shown) via trunnions, while their respective front ends are pivotally supported at the back of the blade 3. The blade 3 is provided with a pair of left and right blade tilt cylinders (hereinafter referred to simply as "tilt cylinders") 4, 5 of the same diameter disposed between the straight frames 1, 2 and the blade 3 for laterally tilting the blade 3. The blade 3 is further provided with a pair of side-by-side blade lift cylinders (omitted in the drawing) disposed between the vehicle body and the blade 3 for raising and lowering the blade 3.

In the hydraulic circuit diagram of FIG. 1, a hydraulic circuit 6 for controlling actuation of the left and right tilt cylinders 4, 5 comprises: a left tilt cylinder driving hydraulic circuit 9 for supplying pressure oil from a hydraulic pump 7 through a first branched oil line 8 to the left tilt cylinder 4; and a right tilt cylinder driving hydraulic circuit 11 for supplying the pressure oil from the hydraulic pump 7 through a second branched oil line 10 to the right tilt cylinder 5. The left tilt cylinder driving hydraulic circuit 9 and right tilt cylinder driving hydraulic circuit 11 are connected in parallel.

The first branched oil line 8 is connected to a pump port 14 of a left tilt cylinder actuation switching valve 13, a three-way switching valve, via a first pressure compensating valve 12. A tank port 15 of the left tilt cylinder actuation switching valve 13 is connected to a tank 16. The left tilt cylinder actuation switching valve 13 also has cylinder ports 17, 18 connected to a head oil chamber 4*b* and a bottom oil chamber 4*a* of the left tilt cylinder 4, respectively.

The second branched oil line 10 is connected to a pump port 21 of a right tilt cylinder actuation switching valve 20—this being also a three-way switching valve—via a second pressure compensating valve 19. A tank port 22 of the right tilt cylinder actuation switching valve 20 is connected to the tank 16. The right tilt cylinder actuation switching valve 20 also has cylinder ports 23, 24 connected to a head oil chamber 5*b* and a bottom oil chamber 5*a* of the right tilt cylinder 5, respectively.

The role of the first and second pressure compensating valves 12, 19 is to adjust the flow rate of the pressure oil passing through the tilt cylinder actuation switching valves 13, 20, respectively so that differential pressure between before and after throttling of each of the tilt cylinder actuation switching valves 13, 20 can always stabilize. Accordingly, even in cases where there is a difference in load pressure between the tilt cylinders 4, 5, the pressure compensating valves 12, 19 interposed automatically adjust respective spool opening areas of the switching valves 13, 20, respectively so that the a velocity at which the left tilt cylinder 4 is actuated can always be equal to a velocity at which the right tilt cylinder 5 is actuated. Specifically, the opening area corresponding to the cylinder with a higher load pressure is opened to facilitate the flow of the pressure oil, while the opening area corresponding to the other cylinder with a lower load pressure is throttled to cause the hard flow of the pressure oil. A displacement time of the left part of the blade 3 can thus be equal to a displacement time of the right part of the blade 3, allowing efficient operation.

The left tilt cylinder actuation switching valve 13 and right tilt cylinder actuation switching valve 20 are switched upon receipt of pressure oil supplied from a pilot pump (not shown) through a pilot valve (not shown) and a pilot pressure signal circuit 25. In the vicinity of a driver's seat of the bulldozer, there is placed an operating lever 26 for switching the pilot valve when manipulated.

In the pilot pressure signal circuit 25, a pilot switching valve 27, a three-way switching valve, is interposed. This pilot switching valve 27 enables the left and right tilt cylinders 4, 5 to switch the blade 3 between a pitch dump (forward tilting) and pitch back (backward tilting) operation, a single tilt operation (tilt operation performed by only the left tilt cylinder 4) and a dual tilt operation (tilt operation performed by both tilt cylinders 4, 5).

Figure 3:
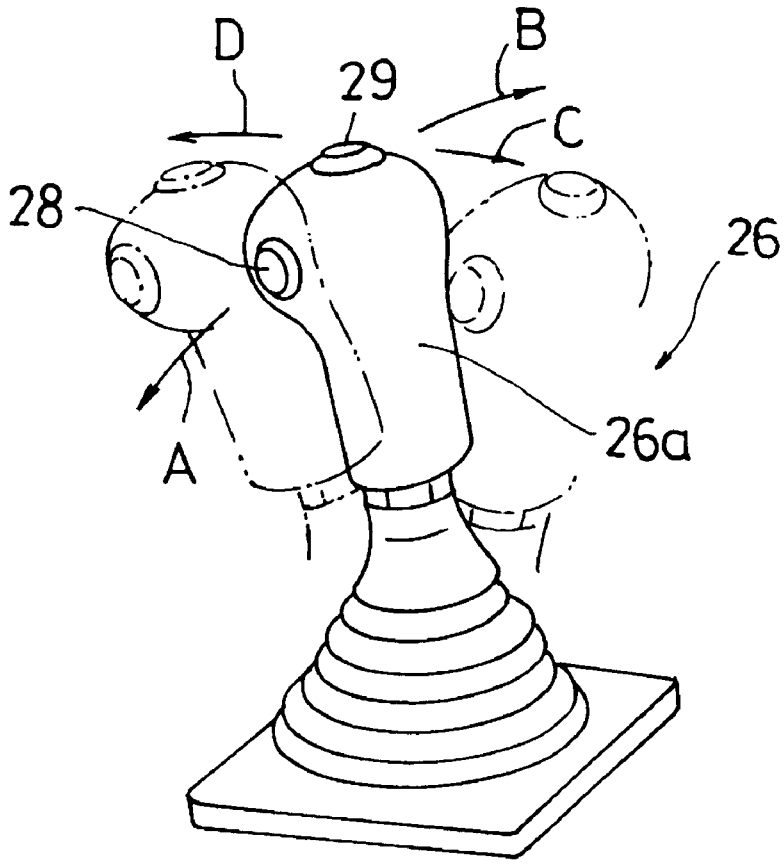
FIG. 3 is a perspective view of an operating lever in accordance with the embodiment.

As shown in FIG. 3, the operating lever 26 is manipulated back (direction indicated by arrow B) and forth (direction indicated by arrow A) or laterally (directions indicated by arrows C and D) with a knob 26*a* gripped. According to the direction manipulated, a required posture of the blade 3 can be controlled. The knob 26*a* is provided with a pitch dump/pitch back switch 28 at its front and a dual tilt switch 29 at its top. When these switches 28, 29 are manipulated, the pilot switching valve 27 is switched to a required position upon receipt of an electric signal.

Figure 4:
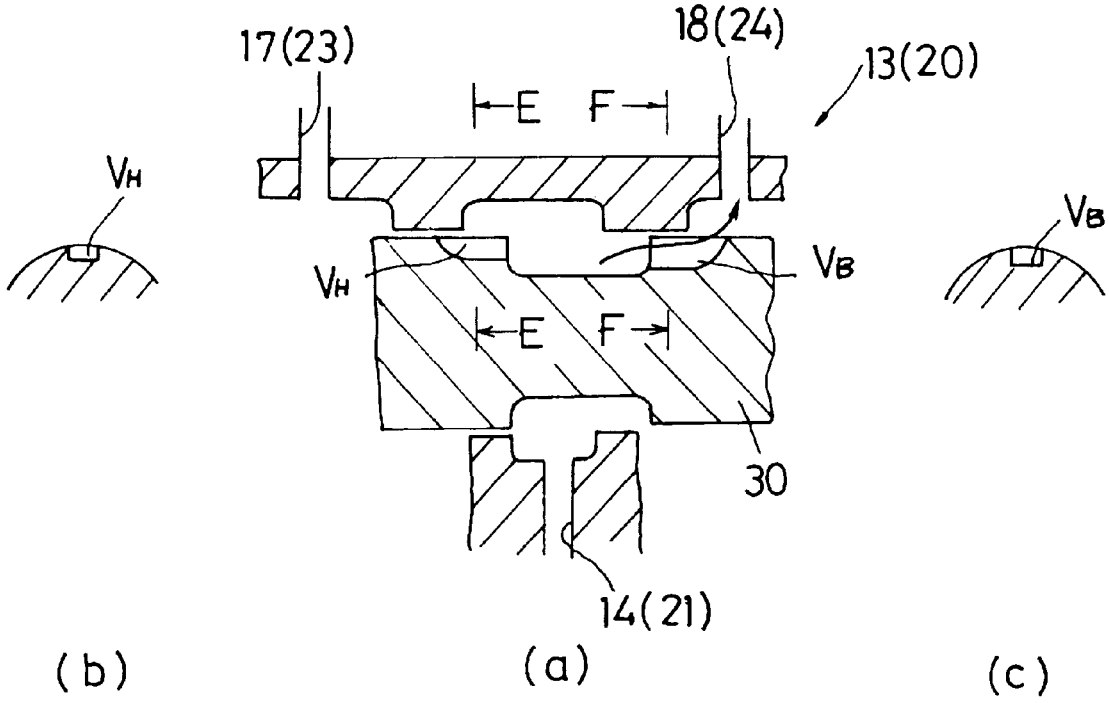
FIG. 4 (*a*) is a partially enlarged view of a tilt cylinder actuation switching valve in accordance with the embodiment, and FIGS. 4(*b*) and 4(*c*) are sectional views of a spool taken along lines E—E and F—F of FIG. 4(*a*), respectively.

In a main spool 30 (see FIG. 4) of the tilt cylinder actuation switching valve 13 (20), a ratio of opening area $V_H$, which is used for supplying the head oil chamber 4*b* (5*b*) of the tilt cylinder 4 (5) with the pressure oil, to opening area $V_B$, which is used for supplying the bottom oil chamber 4*a* (5*a*) of the tilt cylinder 4 (5) with the pressure oil, is set equal to a ratio of cross-sectional area $S_H$ of the head oil chamber 4*b* (5*b*) to cross-sectional area $S_B$ of the bottom oil chamber 4*a* (5*a*) of the tilt cylinder 4 (5). A velocity at which the tilt cylinder 4 (5) extends can thus be equal to a velocity at which the tilt cylinder 4 (5) retracts. In other words, a velocity at which pitch dump caused by the operation of each of the tilt cylinders 4,5 is carried out can be equal to a velocity at which pitch back caused by the operation of each of the tilt cylinders 4,5 is carried out; this facilitates operator's operation.

Actuation of the dual tilt control system in accordance with the present embodiment is explained hereinafter.

In the case of pitch dump, the pilot switching valve 27 is switched to position A when the operating lever 26 is thrown to the right (in the direction indicated by arrow D) with the pitch dump/pitch back switch 28 depressed. Pilot pressure from the pilot pump acts upon an operating part 13*b* of the left tilt cylinder actuation switching valve 13, whereby the left tilt cylinder actuation switching valve 13 is switched to position B, and also acts upon an operating part 20*b* of the right tilt cylinder actuation switching valve 20, whereby the right tilt cylinder actuation switching valve 20 is switched to position B. The pressure oil discharged from the hydraulic pump 7 is thus supplied through the pump port 14 and the cylinder port 18 of the left tilt cylinder actuation switching valve 13 to the bottom oil chamber 4*a* of the left tilt cylinder 4, thereby actuating the left tilt cylinder 4 in an extending direction, and the pressure oil from the head oil chamber 4*b* of the left tilt cylinder 4 is exhausted through the cylinder port 17 and the tank port 15 of the left tilt cylinder actuation switching valve 13 to the tank 16. Simultaneously with this, the pressure oil discharged from the hydraulic pump 7 is supplied through the pump port 21 and the cylinder port 24 of the right tilt cylinder actuation switching valve 20 to the bottom oil chamber 5*a* of the right tilt cylinder 5, thereby actuating the right tilt cylinder 5 in the extending direction, and the pressure oil from the head oil chamber 5*b* of the right tilt cylinder 5 is exhausted through the cylinder port 23 and the tank port 22 of the right tilt cylinder actuation switching valve 20 to the tank 16. Thus, the left and right tilt cylinders 4, 5 are extended simultaneously at an equal velocity, and consequently, the blade 3 performs pitch dump (tilts forward).

In the case of pitch back, the pilot switching valve 27 is switched to position A when the operating lever 26 is thrown to the left (in the direction indicated by arrow C) with the pitch dump/pitch back switch 28 depressed. The pilot pressure from the pilot pump acts upon an operating part 13*a* of the left tilt cylinder actuation switching valve 13, whereby the left tilt cylinder actuation switching valve 13 is switched to position A, and also acts upon an operating part 20*a* of the right tilt cylinder actuation switching valve 20, whereby the right tilt cylinder actuation switching valve 20 is switched to position A. Thus, the pressure oil flows reversely to the direction described above, so that the left and right tilt cylinders 4, 5 are retracted simultaneously at an equal velocity. Consequently, the blade 3 performs pitch back (tilts backward).

In the case of dual tilting to the right, the pilot switching valve 27 is switched to position B when the operating lever 26 is thrown to the right (in the direction indicated by arrow D) with the dual tilt switch 29 depressed. The pilot pressure from the pilot pump acts upon the operating part 13*b* of the left tilt cylinder actuation switching valve 13, whereby the left tilt cylinder actuation switching valve 13 is switched to position B, and also acts upon the operating part 20*a* of the right tilt cylinder actuation switching valve 20, whereby the right tilt cylinder actuation switching valve 20 is switched to position A. The pressure oil discharged from the hydraulic pump 7 is thus supplied through the pump port 14 and the cylinder port 18 of the left tilt cylinder actuation switching valve 13 to the bottom oil chamber 4*a* of the left tilt cylinder 4, thereby actuating the left tilt cylinder 4 in the extending direction, and the pressure oil from the head oil chamber 4*b* of the left tilt cylinder 4 is exhausted through the cylinder port 17 and the tank port 15 of the left tilt cylinder actuation switching valve 13 to the tank 16. Simultaneously with this, the pressure oil discharged from the hydraulic pump 7 is supplied through the pump port 21 and the cylinder port 23 of the right tilt cylinder actuation switching valve 20 to the head oil chamber 5*b* of the right tilt cylinder 5, thereby actuating the right tilt cylinder 5 in a retracting direction, and the pressure oil from the bottom oil chamber 5*a* of the right tilt cylinder 5 is exhausted through the cylinder port 24 and the tank port 22 of the right tilt cylinder actuation switching valve 20 to the tank 16. Thus, the extension of the left tilt cylinder 4 and the retraction of the right tilt cylinder 5 are carried out simultaneously, and consequently, the blade 3 tilts to the right at a high velocity (substantially double the velocity at which the single tilt operation is carried out).

In the case of dual tilting to the left, the pilot switching valve 27 is switched to position B when the operating lever 26 is thrown to the left (in the direction indicated by arrow C) with the dual tilt switch 29 depressed. The pilot pressure from the pilot pump acts upon the operating part 13*a* of the left tilt cylinder actuation switching valve 13, whereby the left tilt cylinder actuation switching valve 13 is switched to position A, and also acts upon the operating part 20*b* of the right tilt cylinder actuation switching valve 20, whereby the right tilt cylinder actuation switching valve 20 is switched to position B. Thus, the pressure oil flows reversely to the direction described above, so that the retraction of the left tilt cylinder 4 and the extension of the right tilt cylinder 5 are carried out simultaneously, and consequently, the blade 3 tilts to the left at a high velocity (substantially double the velocity at which the single tilt operation is carried out).

In the case of single tilting to the right, the pilot switching valve 27 is held in a neutral position when the operating lever 26 is thrown to the right (in the direction indicated by arrow D) with the pitch dump/pitch back switch 28 and the dual tilt switch 29 not depressed. The pilot pressure from the pilot pump acts upon the operating part 13*b* of the left tilt cylinder actuation switching valve 13, whereby the left tilt cylinder actuation switching valve 13 is switched to position B, while the operating parts 20*a*, 20*b* of the right tilt cylinder actuation switching valve 20 are not supplied with the pilot pressure. The pressure oil discharged from the hydraulic pump 7 is thus supplied through the pump port 14 and the cylinder port 18 of the left tilt cylinder actuation switching valve 13 to the bottom oil chamber 4*a* of the left tilt cylinder 4, thereby actuating the left tilt cylinder 4 in the extending direction, and the pressure oil from the head oil chamber 4*b* of the left tilt cylinder 4 is exhausted through the cylinder port 17 and the tank port 15 of the left tilt cylinder actuation switching valve 13 to the tank 16. Thus, only the extension of the left tilt cylinder 4 is carried out with the right tilt cylinder 5 remaining at rest, and consequently, the blade 3 tilts to the right at a normal velocity (low velocity).

In the case of single tilting to the left, the pilot pressure from the pilot pump acts upon the operating part 13*a* of the left tilt cylinder actuation switching valve 13, whereby the left tilt cylinder actuation switching valve 13 is switched to position A. The pressure oil discharged from the hydraulic pump 7 is thus supplied through the pump port 14 and the cylinder port 17 of the left tilt cylinder actuation switching valve 13 to the head oil chamber 4*b* of the left tilt cylinder 4, thereby actuating the left tilt cylinder 4 in the retracting direction, and the pressure oil from the bottom oil chamber 4*a* of the left tilt cylinder 4 is exhausted through the cylinder port 18 and the tank port 15 of the left tilt cylinder actuation switching valve 13 to the tank 16. Thus, only the retraction of the left tilt cylinder 4 is carried out with the right tilt cylinder 5 remaining at rest, and consequently, the blade 3 tilts to the left at a normal velocity (low velocity).

Figure 5:
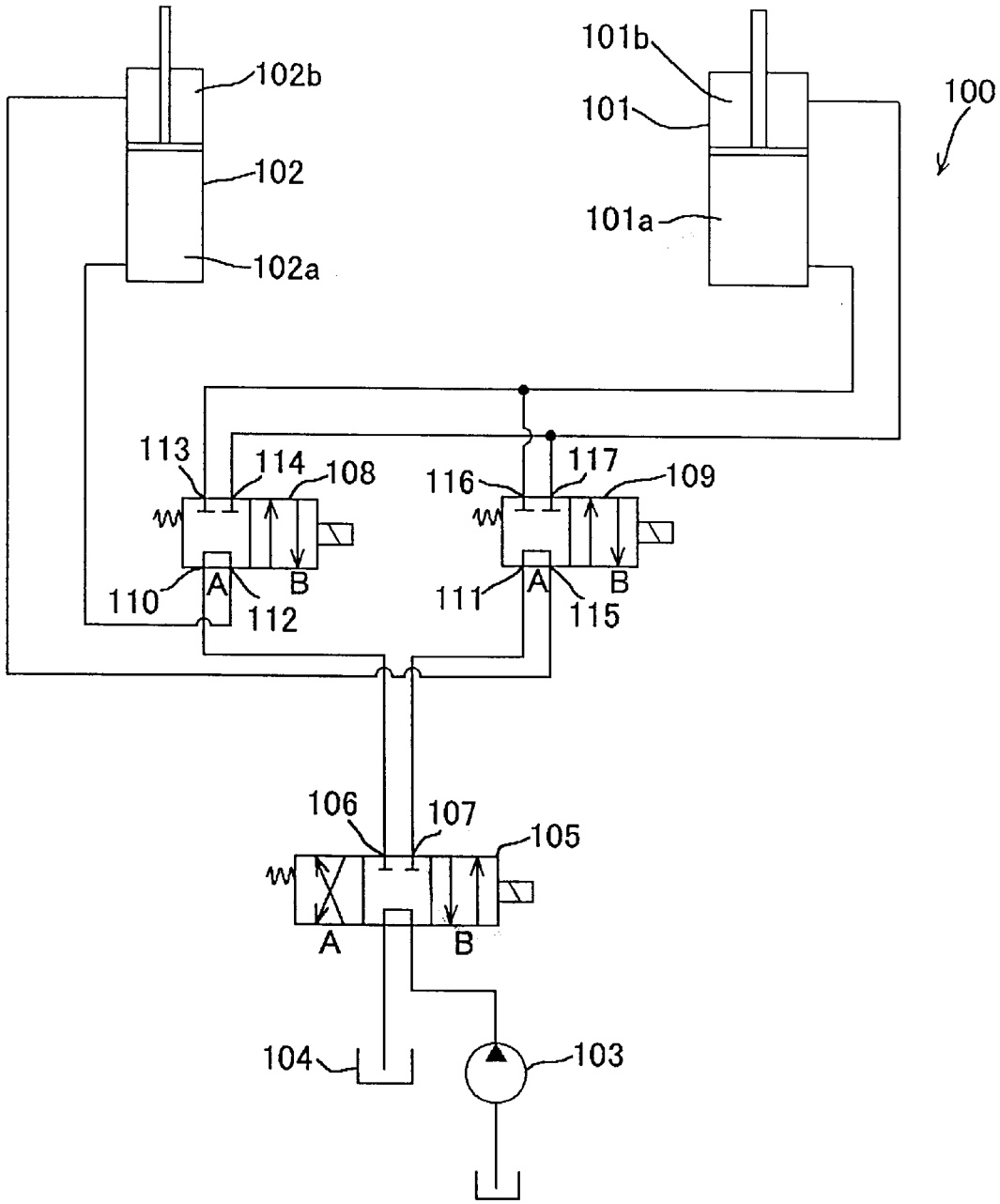
FIG. 5 is a hydraulic circuit diagram of a conventional dual tilt control system.

The dual tilt control system in accordance with the present embodiment has a parallel combination of the left tilt cylinder driving hydraulic circuit 9 and the right tilt cylinder driving hydraulic circuit 11, so that unlike the conventional case where the left and right tilt cylinders are arranged in series (see FIG. 5), the left and right tilt cylinders 4, 5 of the same diameter can be used, and large hydraulic force can be applied during the pitch operation and dual tilt operation, thereby effectively yielding large force. Moreover, the system benefits from the fact that there is no need to annex a piston valve for relieving the pressure oil at a stroke end to each of the tilt cylinders. Furthermore, through the actuation of the pilot switching valve 27, the left and right tilt cylinders 4, 5 are switched between the various operations, so that the pilot switching valve 27 can simply be adapted to low pressure and low flow rates; this advantageously avoids a cost increase.

In the present embodiment, the explanation has referred to the pressure compensating valves 12, 19 disposed on the respective upstream sides of the tilt cylinder actuation switching valves 13, 20, respectively; however, the pressure compensating valves 12, 19 can be disposed on the respective downstream sides of the tilt cylinder actuation switching valves 13, 20, respectively.

What is claimed is:

1. A dual tilt control system for a work vehicle, the dual tilt control system comprising: a blade pivotably connected to a vehicle body; a pair of left and right tilt cylinders disposed between the blade and the vehicle body; and tilt cylinder controlling means for controlling actuation of the tilt cylinders, the tilt cylinder controlling means comprising a hydraulic circuit comprising:

a left tilt cylinder driving hydraulic circuit for supplying pressure oil from a hydraulic pump to the left tilt cylinder, the left tilt cylinder driving hydraulic circuit comprising a left tilt cylinder actuation switching valve;

a right tilt cylinder driving hydraulic circuit for supplying the pressure oil from the hydraulic pump to the right tilt cylinder, the right tilt cylinder driving hydraulic circuit comprising a right tilt cylinder actuation switching valve; and a pilot pressure signal circuit for controlling the left tilt cylinder actuation switching valve and the right tilt cylinder actuation switching valve, the pilot pressure signal circuit comprising a pilot switching valve for switching the blade between a pitch operation, a single tilt operation and a dual tilt operation by means of the left and right tilt cylinders, wherein the left tilt cylinder driving hydraulic circuit and the right tilt cylinder driving hydraulic circuit are arranged in parallel.

2. The dual tilt control system as defined in claim 1, further comprising a pressure compensating valve provided on either an upstream side or a downstream side of each of the left and right tilt cylinder actuation switching valves so that a differential pressure between the upstream and downstream sides of each of the left and right tilt cylinder actuation switching valves can stabilize.

3. A dual tilt control system for a work vehicle, the dual tilt control system comprising: a blade pivotably connected to a vehicle body; a pair of left and right tilt cylinders disposed between the blade and the vehicle body; and tilt cylinder controlling means for controlling actuation of the tilt cylinders, the tilt cylinder controlling means comprising a hydraulic circuit comprising:

a left tilt cylinder driving hydraulic circuit for supplying pressure oil from a hydraulic pump to the left tilt cylinder, the left tilt cylinder driving hydraulic circuit comprising a left tilt cylinder actuation switching valve;

a right tilt cylinder driving hydraulic circuit for supplying the pressure oil from the hydraulic pump to the right tilt cylinder, the right tilt cylinder driving hydraulic circuit comprising a right tilt cylinder actuation switching valve; and a pilot pressure signal circuit for controlling the left tilt cylinder actuation switching valve and the right tilt cylinder actuation switching valve, the pilot pressure signal circuit comprising a pilot switching valve for switching the blade between a pitch operation, a single tilt operation and a dual tilt operation by means of the left and right tilt cylinders, wherein the left tilt cylinder driving hydraulic circuit and the right tilt cylinder driving hydraulic circuit are arranged in parallel, and each of the left and right tilt cylinder actuation switching valves has a ratio of a main spool opening area, which is used for supplying a head oil chamber of each of the left and right tilt cylinders with the pressure oil, to a main spool opening area, which is used for supplying a bottom oil chamber of each of the left and right tilt cylinders with the pressure oil, that is set equal to a ratio between respective cross-sectional areas of a head oil chamber and a bottom oil chamber of each of the tilt cylinders.

4. A dual tilt control system for a work vehicle, the dual tilt control system comprising: a blade pivotably connected to a vehicle body; a pair of left and right tilt cylinders disposed between the blade and the vehicle body; and tilt cylinder controlling means for controlling actuation of the tilt cylinders, the tilt cylinder controlling means comprising a hydraulic circuit comprising:

a left tilt cylinder driving hydraulic circuit for supplying pressure oil from a hydraulic pump to the left tilt cylinder, the left tilt cylinder driving hydraulic circuit comprising a left tilt cylinder actuation switching valve;

a right tilt cylinder driving hydraulic circuit for supplying the pressure oil from the hydraulic pump to the right tilt cylinder, the right tilt cylinder driving hydraulic circuit comprising a right tilt cylinder actuation switching valve;

a pilot pressure signal circuit for controlling the left tilt cylinder actuation switching valve and the right tilt cylinder actuation switching valve, the pilot pressure signal circuit comprising a pilot switching valve for switching the blade between a pitch operation, a single tilt operation and a dual tilt operation by means of the left and right tilt cylinders; and a pressure compensating valve provided on either an upstream side or a downstream side of each of the left and right tilt cylinder actuation switching valves so that a differential pressure between the upstream and downstream sides of each of the left and right tilt cylinder actuation switching valves can stabilize; wherein the left tilt cylinder driving hydraulic circuit and the right tilt cylinder driving hydraulic circuit are arranged in parallel, and each of the left and right tilt cylinder actuation switching valves has a ratio of a main spool opening area, which is used for supplying a head oil chamber of each of the left and right tilt cylinders with the pressure oil, to a main spool opening area, which is used for supplying a bottom oil chamber of each of the left and right tilt cylinders with the pressure oil, that is set equal to a ratio between respective cross-sectional areas of a head oil chamber and a bottom oil chamber of each of the tilt cylinders.

* * * * *